United States Patent [19]

Smith et al.

[11] Patent Number: 4,648,987

[45] Date of Patent: Mar. 10, 1987

[54] THICKENED AQUEOUS PREWASH COMPOSITION

[75] Inventors: William L. Smith, Pleasanton; Barbara H. Munk, Albany, both of Calif.

[73] Assignee: The Clorox Company, Oakland, Calif.

[21] Appl. No.: 701,368

[22] Filed: Feb. 13, 1985

[51] Int. Cl.[4] ..... C11D 1/831; C11D 3/14; C11D 3/37

[52] U.S. Cl. ..... 252/559; 252/174.12; 252/174.17; 252/174.21; 252/174.22; 252/174.23; 252/174.24; 252/174.25; 252/DIG. 2; 252/DIG. 14; 252/173

[58] Field of Search ..... 252/174.12, 174.17, 252/174.22, 174.23, 174.24, 174.25, 174.21, 559, DIG. 14, 173

[56] References Cited

U.S. PATENT DOCUMENTS

| | | | |
|---|---|---|---|
| 3,619,119 | 11/1971 | Felletschin et al. | 8/137 |
| 3,625,909 | 12/1971 | Berg et al. | 252/153 |
| 3,707,506 | 12/1972 | Lozo | 252/139 |
| 4,260,528 | 4/1981 | Fox et al. | 252/525 |
| 4,284,533 | 8/1981 | Imamura et al. | 252/542 |
| 4,362,638 | 12/1982 | Caskey et al. | 252/90 |
| 4,438,009 | 3/1984 | Brusky et al. | 252/90 |
| 4,465,619 | 8/1984 | Boskamp | 252/540 |
| 4,532,066 | 7/1985 | Paszek et al. | 252/144 |
| 4,581,153 | 4/1986 | Trabitzsch et al. | 252/140 |

FOREIGN PATENT DOCUMENTS

| | | |
|---|---|---|
| 540798 | 5/1957 | Canada . |
| 2459278 | 2/1981 | France . |
| 46303 | 4/1978 | Japan . |

OTHER PUBLICATIONS

Kelco, Xanthan Gum, Merck & Co. 2nd Ed.

*Primary Examiner*—Prince E. Willis

*Attorney, Agent, or Firm*—Stephen M. Westbrook; Joel J. Hayashida; John A. Bucher

[57] ABSTRACT

An aqueous laundry prewash composition includes a cosurfactant system with a hydrophobic nonionic surfactant and a hydrophilic nonionic surfactant providing balanced detergency, a hydrotrope for stabilizing the cosurfactant system, a thickener and water forming the balance of the composition. A thickened aqueous laundry prewash composition is also disclosed including a surfactant system, water and a thickener being xanthan gum to develop a pourable product wherein shear caused by dispensing of the composition tends to reduce its viscosity. An aqueous laundry prewash composition thickened in a similar manner maintains in suspension an insoluble particle component to further enhance prewash characteristics.

14 Claims, 2 Drawing Figures

FIGURE 1 PHASE STABILITY FOR THICKENED PREWASH AT 38°c
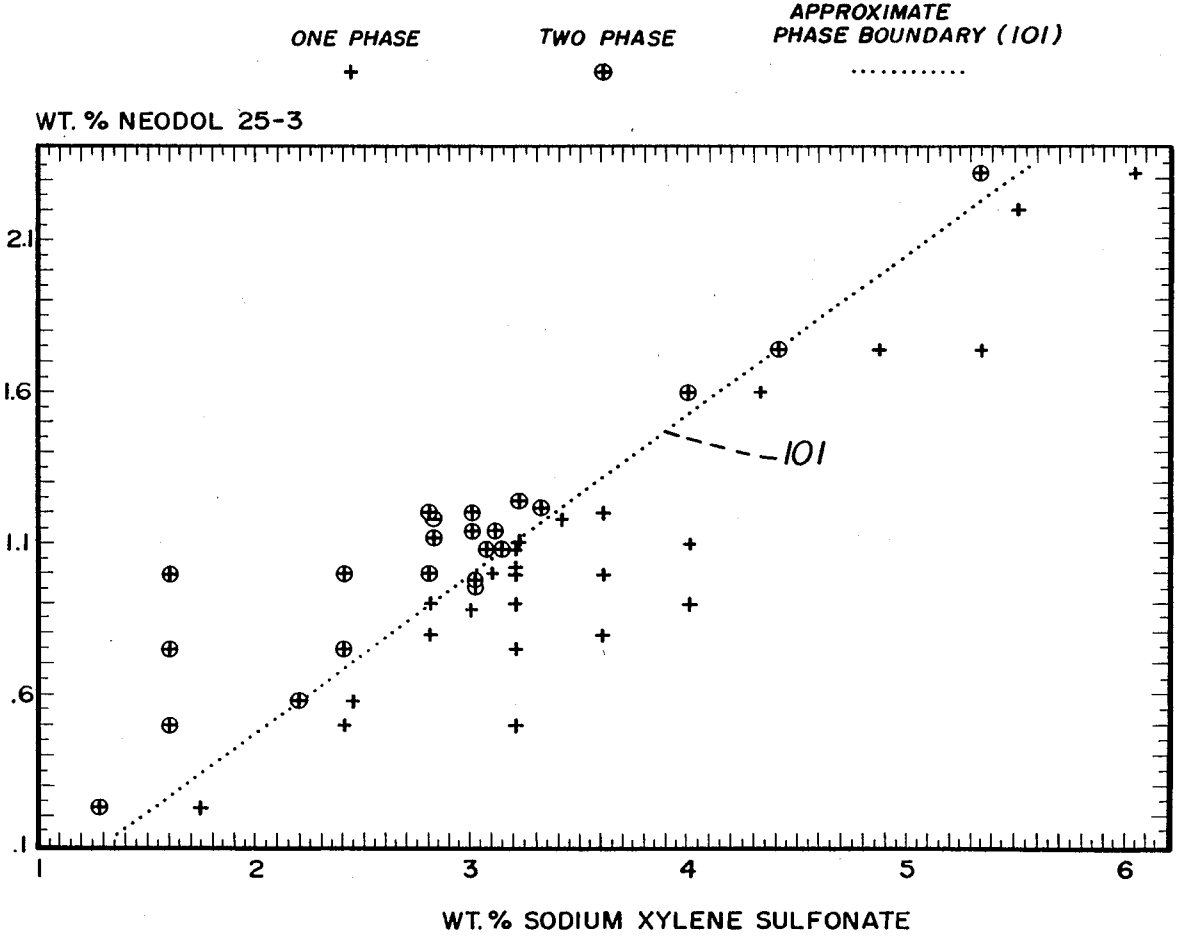

FIGURE 2 BROOKFIELD VISCOSITY OF THICKENED PREWASH
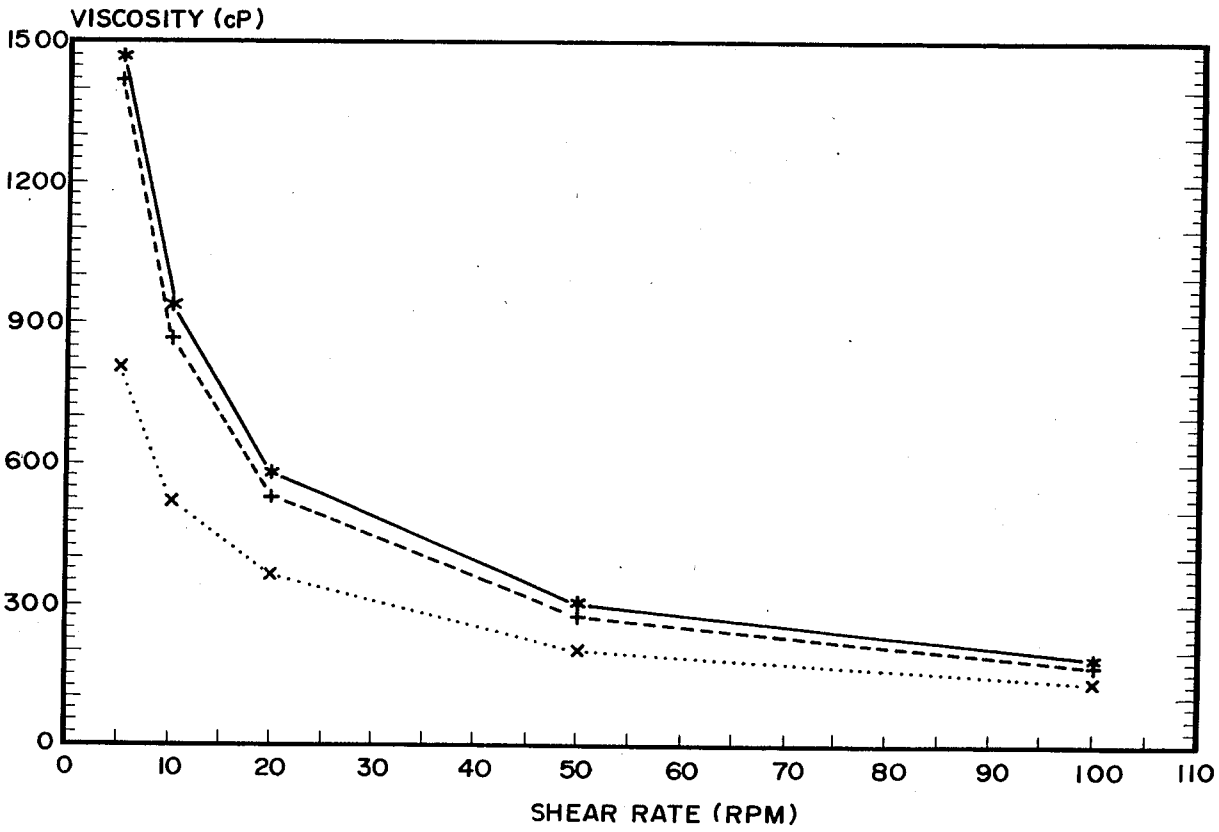

THICKENED AQUEOUS PREWASH COMPOSITION

BACKGROUND OF THE INVENTION

The present invention relates to a laundry prewash composition and preferably to such a laundry prewash composition which is aqueous in nature.

Numerous prewash compositions of the type generally contemplated by the present invention have been disclosed in the prior art. The need for such prewash compositions has long been known because of the general inability for common washing techniques to loosen or remove certain spots, stains or the like on various fabrics. Such spots and stains may be either oil soluble or water soluble and may appear upon a variety of textiles including cottons, synthetic fibers, mixed cotton and synthetic fibers, silks and wools for example.

Even where such washing techniques are carried out with relatively high temperatures, certain spots and stains on fabrics may be difficult to remove entirely in a single washing. It is for this reason that the use of prewash compositions has been adopted. Initially, such prewash compositions were formed from concentrated detergent, of the type normally used in the wash cycle, applied directly onto the fabric spots or stains. The soiled area of the textile with the concentrated detergent in place was then rubbed or otherwise treated in order to enhance action of the detergent upon the spots or stains. In these initial techniques, the detergent could be applied either directly in the case of a liquid detergent or by addition of small amounts of water to form a paste from dry detergents.

More recently, specific prewash compounds have been developed particularly for application to fabric spots and stains which would otherwise be difficult to clean by conventional washing procedures. The effectiveness of these early prewash compositions was commonly enhanced by the addition of substantial quantities of surfactants, for example, either anionic or nonionic, and/or various organic or hydrocarbon based solvents. These surfactants and solvents were employed because of their known ability to loosen or otherwise remove particular fabric spots and stains. Prewash compositions of the types available in the prior art tend to be either mixtures of one or more surfactants and a small amount of an organic solvent or solvents in a relatively large amount of water or mixtures of surfactants in hydrocarbon or other organic solvents with very little water. The latter type of product is commonly very effective on oil soluble stains while being generally more expensive.

Numerous prewash compositions including water as either a major or predominant component have been disclosed in the prior art and have been intended to resolve one or more problems arising because of the use of water as a component in the composition. For example, it is often difficult to maintain various prewash components in suspension in an aqueous system, particularly when the temperature of the composition tends to vary widely.

Augustijn U.S. Pat. No. 4,201,686 issued May 6, 1980, disclosed an aqueous liquid detergent composition containing mixtures of nonionic surfactants selected and combined in an aqueous medium for producing a stable composition which was nongelling at low temperatures.

Similarly, Canter U.S. Pat. No. 4,058,473, issued Nov. 15, 1977, disclosed a number of liquid detergent compositions containing potassium tallowate soap, nonionic detergent combinations forming at least 12 percent of the composition, hydrotropes, glycerin and other adjuncts for producing low temperature stable compositions.

Claybaugh U.S. Pat. No. 3,970,594 disclosed a number of dry granular cleaning compositions while stating that the compositions could be diluted to a liquid consistency. However, at the diluted strengths taught by Claybaugh, there would not appear to be a sufficient amount of the cleaning composition to afford any thickening.

Compositions of the type set forth in the above noted patents are contrasted for example to Berg U.S. Pat. No. 3,625,909 issued Dec. 7, 1971 which disclosed liquid spot removing agents consisting of at least about 50 percent total surfactant to provide proper detergency, from 2 to 10 percent by weight of a selected hydrotrope for improving clear solubility and viscosity behavior at low temperatures and from 2 to 50 percent by weight of an organic solvent with only 0 to 15 percent by weight water.

Another problem in both aqueous and nonaqueous prewash compositions is their relatively low viscosities which tend to prevent concentration of the prewash composition on the fabric spots and stains. In order to facilitate concentration of the prewash composition on the spots and stains, Felletschin et al U.S. Pat. No. 3,619,119 disclosed a spot treating composition comprising at least 29 percent total surfactant, 1 percent or more of a hydrotrope such as sodium xylene sulfonate and polyethylene glycol having a pasty composition suitable for being easily rubbed onto various textiles.

In a related vein, Kuzel et al U.S. Pat. No. 4,405,483 issued Sept. 20, 1983 disclosed various stable liquid detergent compositions containing from about 30 to about 88 percent by weight water, surfactants, builders, aluminosilicate particles being maintained in suspension by adjusting the pH of the composition in order to partially gelatinize the aluminosilicate material. However, it is noted that this patent was more concerned with maintaining the aluminosilicate particles as well as other detergent ingredients in a stable suspension within the composition rather than adapting the composition for localized treatment of fabric spots and stains.

Although various prior art disclosures and references have dealt with a number of problems encountered in prewash compositions, there has been found to remain a need for a prewash composition having suitable detergency for dealing with a variety of spots and stains normally encountered in various fabrics, the composition being thickened in order to enhance its localized application to the fabric spots and stains.

SUMMARY OF THE INVENTION

It is therefore an object of the present invention to provide a prewash composition having various desirable characteristics such as those summarized above.

It is a further object of the invention to provide an aqueous laundry prewash composition including a surfactant system selected with suitable detergency characteristics for loosening spots and stains from fabric, the composition including water as a predominant component and a thickener selected for conditioning the prewash composition for remaining in localized engagement on selected fabric spots and stains.

It is a related object of the invention to provide such an aqueous laundry prewash composition wherein the surfactant system comprises cosurfactants including a first relatively hydrophobic nonionic surfactant for loosening oil soluble material from the fabric and a second relatively hydrophilic nonionic surfactant for loosening water soluble material from the fabric, a hydrotrope being employed for stabilizing the cosurfactant system and particularly the first relatively hydrophobic nonionic surfactant in the composition. Preferably, the hydrotrope is present in the composition in a ratio of at least about three parts for each part of the first relatively hydrophobic nonionic surfactant in order to assure stability of the thickened prewash composition. Although the proportion of hydrotrope to hydrophobic surfactant is set forth above and hereinafter as at least or about 3:1, the ratio is more precisely defined by an equation set forth below. The ratio of about 3:1 appears to apply for most surfactant percentages considered in the invention. However, for relatively high percentages of hydrophobic surfactant, the ratio may be as low as about 2:1. Conversely, for very low concentrations of hydrophobic surfactant, for example, less than about two percent by weight, the ratio is greater than 3:1 as demonstrated by the following equation. However, it is again noted that the minimum ratio of about 3:1 applies for most useful detergent concentrations.

Within an aqueous prewash composition of the type summarized immediately above, the first relatively hydrophobic nonionic surfactant is preferably an oil soluble ethoxylated alcohol having in the range of about eight to eighteen carbon atoms and an average of about two to five ethylene oxide groups per molecule, the mole ratio of ethylene oxide to alcohol being adjusted to provide an HLB of between about seven and eleven.

The second relatively hydrophilic nonionic surfactant is preferably a water soluble ethoxylated alcohol having in the range of about eight to eighteen carbon atoms and an average of about five to fifteen ethylene oxide groups per molecule, the mole ratio of ethylene oxide to alcohol being adjusted to provide a cloud point of at least about 40° C. and an HLB of at least about eleven.

The hydrotrope is preferably selected from the class consisting of benzene or naphthalene sulfonates containing at least one short chain alkyl substituent with about one to four carbon atoms. However, a number of other hydrotropes, for example, those commonly employed in detergent compositions, would also be suitable in this invention.

It is a further object of the invention to provide an aqueous laundry prewash composition as summarized above wherein the thickener is selected for maintaining viscosity of the composition in the range of about 50 to 2,000 centipoise and more preferably from about 100 to 300 centipoise in order to form a pourable product tending to remain in localized engagement on the fabric spots and stains. The viscosities set forth above and elsewhere herein are measured with a Brookfield viscosimeter using a number two spindle at 100 rpm and 21° C. (70° F).

It is a further related object of the invention to provide such a thickened aqueous laundry prewash composition wherein the thickener is further selected for maintaining thixotropic conditions in the prewash composition whereupon increased shear caused by dispensing of the prewash composition substantially reduces its viscosity to facilitate pouring, viscosity of the product under low shear otherwise causing the product to remain in localized engagement on the fabric spots and stains.

It is yet another object of the invention to provide a thickened aqueous laundry prewash composition with a surfactant system having suitable detergency characteristics as noted above, the thickener being xanthan gum comprising from about 0.1 to as much as 3 percent by weight of the prewash composition for maintaining the composition in localized engagement on the fabric spots and stains.

It is particularly noted in connection with the present invention that xanthan gum has been found to be an unexpectedly effective agent for maintaining viscosity and thixotropy in a prewash composition suitable for forming a pourable product which tends to remain in localized engagement on fabric spots and stains, the thixotropic nature of the prewash composition caused by the presence of the xanthan gum tending to reduce viscosity of the composition during dispensing in order to facilitate pouring or application of the product to the fabric spots and stains, the viscosity of the composition under low shear otherwise causing the product to remain in localized engagement on the fabric spots and stains as noted above.

It is a further related object of the invention to provide a thickened aqueous prewash composition including one or more insoluble (or partially soluble) particles, the viscosity of the prewash composition being selected for maintaining the insoluble particle component in suspension. The insoluble particle component is preferably selected from the class consisting of enzyme prills, bluing agents, dyeing agents and abrasives selected for enhancing action of the prewash composition on the fabric spots and stains.

The inclusion of such insoluble particle components in an aqueous prewash composition has been found to be particularly novel and effective for enhancing the ability of the composition to loosen or remove spots and stains from various fabrics.

It will be obvious that various adjuncts, of a generally conventional nature within prewash compositions, may be used in addition to those summarized above. For example, the prewash compositions of the present invention may include small amounts of dyes, fluorescent whitening agents, fragrances, builders, solvents or preservatives such as formalin (37 percent aqueous formaldehyde). However, it is to be kept in mind that the presence of such adjuncts should preferably be controlled, generally at minimum effective levels, in order to avoid interfering with the desirable characteristics of the prewash composition as summarized above.

It is another related object of the invention to provide a method for removing localized soil from a fabric by contacting the localized fabric soil with a prewash composition selected according to the present invention.

Other and further objects of the present invention will be apparent from the following description and claims which, by way of illustration, set forth preferred embodiments of the invention and its principles and what is now considered to be the best modes contemplated for the invention. Other embodiments of the invention employing the same or equivalent principles may be used as desired by those skilled in the art without departing from the present invention and the purview of the appended claims.

BRIEF DESCRIPTION OF THE DRAWINGS

FIG. 1 is a graphical representation illustrating phase stability for a thickened prewash composition according to the present invention by adjusting the ratio of a hydrotrope to a relatively hydrophobic surfactant.

FIG. 2 is also a graphical representation illustrating viscosity variations in a thickened prewash composition according to the present invention as a function of shear rate.

DESCRIPTION OF THE PREFERRED EMBODIMENTS

As noted above, the present invention relates to a thickened laundry prewash composition which is particularly contemplated for localized application to various fabrics for loosening spots and stains before the fabrics are subjected to a conventional laundry cycle. The thickened consistency of the composition is desirable in order to facilitate application of the composition to the fabric spots and stains while assuring that the composition remains in generally localized engagement with the spots and stains to enhance its activity.

If the composition or product is excessively thick, its application to the fabric is more difficult. On the other hand, if the composition or product is excessively thin, the composition will not remain in localized engagement with the spots and stains. Commonly, a relatively thin product will tend to "wick" through the fabric so that only a portion of it remains in engagement with the spots or stains.

Preferably, the present invention contemplates such a thickened prewash composition having a viscosity suitable for use with dispensers of a type including a push-pull closure. For this reason, the present invention most preferably contemplates a prewash composition which is thickened to have a viscosity generally in the range of about 100 to 300 centipoise.

However, thickened prewash compositions having different viscosities may be suitable for use with different dispensers such as those including pump or trigger sprayer elements. In order to adapt the present invention for use with such different dispensers and also to adapt the prewash composition for other applications, it is accordingly contemplated that the viscosity of the composition be maintained in the general range of about 50 to 2,000 centipoise.

To further characterize the prewash composition of the present invention, it is an aqueous product with water being a predominant component forming at least 50 percent by weight of the composition. Preferably, water will form approximately 80 to 90 percent by weight of the composition as will be discussed in greater detail below. However, these water percentages apply only to the aqueous prewash composition and not to any insoluble particles suspended therein as described in greater detail below.

In addition to the predominant component of water, the prewash composition also includes a surfactant system selected for having desirable detergent characteristics for loosening selected spots and stains on various fabrics. Such detergency characteristics in themselves are well known in the prior art but, in accordance with the present invention, are combined with additional features as summarized immediately below.

In addition to exhibiting appropriate detergency properties, components of the prewash composition are also necessarily selected in order to assure stability in the liquid or aqueous prewash composition overall.

As will also be discussed and illustrated in greater detail below, the surfactant system may for example be formed with a single surfactant preferably exhibiting both hydrophilic and hydrophobic characteristics in order to enhance detergent characteristics of the single surfactant for both water soluble and oil soluble stains or spots.

On the other hand, it is also a particular feature of the present invention to provide a cosurfactant system including both a relatively hydrophilic nonionic surfactant and a relatively hydrophobic nonionic surfactant, the two surfactants being selected in combination to provide particularly effective detergency characteristics. The characteristics of these two nonionic surfactants are also discussed in greater detail below.

Particularly in connection with a cosurfactant system as noted immediately above, the present prewash composition is also preferably contemplated as including a hydrotrope selected for assuring stability of the prewash composition, especially in connection with the relatively hydrophobic surfactant of the cosurfactant system. Preferably, it is contemplated within the hydrotrope is present in the ratio of at least three parts by weight for each part of the relatively hydrophobic surfactant noted above.

Another essential component of the prewash composition of the present invention comprises a thickener capable of establishing the preferred viscosity range as discussed above. Generally, it is desirable that a thickener for the prewash composition of the present invention be suitable for providing sufficient thickening at low concentrations in the prewash composition. This is of course desirable in order to allow water to be an inexpensive predominant component of the composition. However, it is equally important that the thickener not only achieve viscosity control as summarized above but that it also result in or at least not interfere with stability of the overall composition. This requirement for the composition to remain stable or in a single liquid phase will be more apparent from the following discussion and examples.

In connection with an appropriate thickener for use in the aqueous prewash composition of the present invention, it was found that most thickeners of the type normally contemplated for use in such products were unsatisfactory because they resulted in instability of the composition. For example, as will be discussed in greater detail below, most conventional thickeners resulted either in the prewash composition breaking up into more than one liquid phase or in undesirable gelling, making it difficult to properly apply the composition to the fabric spots and stains.

Of the limited number of thickening agents found suitable for use in the prewash composition of the present invention, xanthan gum was found to be superior both in terms of providing substantial thickening at low concentrations while also maintaining proper stability of the entire prewash composition. In this connection, a preferred composition for an aqueous prewash composition according to the present invention comprises a cosurfactant system as summarized above, a hydrotrope present in the ratio of at least about three parts to one based on relatively hydrophobic nonionic surfactant within the cosurfactant system and xanthan gum as a thickener. However, it will also be apparent from the following discussion and examples that other compositions are also possible for a prewash composition in accordance with the present invention.

In addition to providing high viscosity within the prewash composition, thickeners such as xanthan gum have also been found to make the composition more thixotropic which even further contributes to use of the prewash composition for treating fabric spots and stains. For example, because of the thixotropic nature of the composition, it tends to react to increased shear conditions, such as are developed by dispensing of the product, by a substantial lowering of viscosity. Thus, the prewash composition is more readily pourable because of this thixotropic property. However, once the prewash composition is applied to the fabric spots or stains, its viscosity is again substantially increased upon termination of shear conditions. Thus, the composition tends to remain in localized engagement upon the fabric spots and stains to further enhance its treatment thereof.

Yet another feature of the present invention was found to be related to the thickened consistency or high viscosity of the prewash composition. In this connection, it was unexpectedly discovered that the thickened aqueous prewash composition novelly provided the capability for maintaining in suspension various components known to have desirable characteristics for use in such prewash compositions but generally not included because of their insoluble nature and their tendency to separate from such liquid prewash compositions into a separate solid phase. For example, the aqueous prewash composition of the present invention was found suitable for maintaining in suspension insoluble particles including for example enzyme prills, bluing agents such as ultramarine blue, dyeing agents and even various abrasives. The use of insoluble abrasives in a prewash composition is believed to be particularly novel. Obviously, the presence of such abrasives substantially enhances detergency of the composition when the fabric is rubbed with the composition being applied to spots and stains thereon.

The general characteristics and features of the aqueous thickened prewash composition of the present invention as summarized above will be more apparent from the following detailed discussion and examples.

Before discussing components of the composition in detail, it is also noted that the prewash composition may include one or more adjuncts which do not to affect the viscosity or stability of the composition in accordance with the present invention but may provide well known functions in a prewash product. Such adjuncts include for example optional ingredients such as perfumes, dyes, pigments, pH regulating agents, soil suspending agents, chelating agents, and fluorescent whitening agents. Generally, these additives or adjuncts as listed above are present at low levels of for example 0.1 to 1 percent by weight. Other adjuncts which may also be included in such a composition include solvents for example and Formalin (37 percent aqueous formaldehyde) which functions as a preservative for the prewash composition.

The various components summarized above are discussed in further detail below under the headings Surfactant System (Including Cosurfactants and Hydrotropes), Water, Thickener and Insoluble Particles which are contemplated for suspension by the thickened aqueous prewash composition of the present invention.

SURFACTANT SYSTEM

As noted above, the surfactant system preferably includes cosurfactants in the form of a relatively hydrophobic nonionic surfactant and a relatively hydrophilic nonionic surfactant. Preferred examples of these surfactants are set forth below together with a statement also defining suitable equivalents.

Within the preferred cosurfactant system of the present invention, the relatively hydrophobic surfactant is an oil soluble, nonionic surfactant that is only partially soluble in water. A preferred hydrophobic nonionic surfactant suitable for use within the present invention is a linear alcohol ethoxylate having an average of about twelve to fifteen carbon atoms with an average of about three ethylene oxide groups per molecule. Such a surfactant is available for example under the trade name Neodol 25-3 from Shell Oil Company.

The preferred hydrophobic nonionic surfactant noted above may be replaced in the prewash composition of the present invention by other nonionic hydrophobic surfactants generally characterized as oil soluble ethoxylated alcohols with about eight to eighteen carbon atoms and an average of about two to five ethylene oxide groups per molecule. In addition, the mole ratio of ethylene oxide to alcohol within the hydrophobic surfactant is to be adjusted to provide an HLB (hydrophile/lipophile balance) of between about seven and eleven.

Hydrophile-lipophile balance (or HLB) is a conventional term or parameter apparently first described by W. C. Griffin of the Atlas Powder Company ("*Surface Active Agents*", Wilmington, Del., 1948, pp. 26–27) as a means for comparing the hydrophilic and lipophilic properties of different surfactants. Under this convention, a more hydrophilic surfactant is indicated by a larger HLB value and vice versa. For ethoxylated alcohols, for example, the HLB is calculated by the equation:

$$\text{HLB} = \text{Wgt. \% ethylene oxide in the surfactant}/5$$

See Schwartz et al, Surface Active Agents and Detergents, Vol. II, pp. 479–480 (1977). A method of calculating HLB values is shown in Shick, *Nonionic Surfactants*, Vol. I, pp. 607–608 (1967).

The other relatively hydrophilic nonionic surfactant is generally characterized as a water soluble nonionic surfactant. A preferred example of such a surfactant is a linear alcohol ethoxylate having an average of about twelve to thirteen carbon atoms with an average of about 6.5 ethylene oxide groups per molecule. Such a surfactant is commercially available under the trade name Neodol 23-6.5 also from Shell Oil Company. Equivalent surfactants for the relatively hydrophilic nonionic surfactant noted above include any water soluble ethoxylated alcohol with about eight to eighteen carbon atoms and an average of about five to fifteen ethylene oxide groups per molecule. The mole ratio of ethylene oxide to alcohol within the relatively hydrophilic surfactant is to be adjusted to provide a cloud point greater than about 40° C. and an HLB greater than about eleven.

A number of equivalent nonionic surfactants are readily available for both the hydrophobic and hydrophilic surfactants noted above. For example, a listing of linear alcohol nonionic surfactants equivalent to both the hydrophobic and hydrophilic surfactants in accordance with the preceding definitions is set forth in a brochure available from Shell Oil Company, "*Neodol Ethoxylates—Properties and Comparison Guide*" (SC:405-79RR), October, 1979.

Another discussion of equivalent nonionic surfactants is set forth in the *Kirk-Othmer Encyclopedia of Chemical Technology,* Third Edition, Volume 22, pages 364 and 365, published by John Wiley & Sons, Inc. (1983).

In considering various equivalent nonionic surfactants, certain adjustments may be necessary in connection with the preceding definitions. For example, one equivalent surfactant may be a phenol (with one or more linear or branched alkyl substituents each having typically 6 to 12 carbon atoms) used in place of the linear alcohol surfactants discussed above. For example, a nonyl phenol molecule is formed with a phenol ring and a chain of nine carbon atoms. Thus, although the nonyl phenol molecule has a total of fifteen carbons, it is considered as having about ten to twelve carbon atoms in accordance with the preceding definition. This adjustment is necessary since the phenol ring including six carbon atoms is believed to be about equivalent to a straight chain of about two and one half carbon atoms, at least for purposes of the present invention.

Similarly, branched chain alcohol ethoxylates or surfactants in the form of secondary alcohol ethoxylates are predictable in generally the same manner described above for phenol surfactants as equivalents within the present invention.

Within the preceding definitions for the relatively hydrophobic and hydrophilic surfactants, the basic statement of function for the surfactants is based on ethoxylated alcohols. However, it is also to be noted in certain nonionic surfactants that at least a portion of the ethylene oxide groups may be replaced by propylene oxide groups so that the alcohols may be at least partially propoxylated while still qualifying in accordance with the preceding definitions.

Finally, it is noted again that the preceding definitions for the hydrophobic and hydrophilic surfactants specify nonionic surfactants. This limitation is partially qualified in that semi-polar nonionic surfactants such as amine oxides, phosphine oxides and sulfoxide surfactants are also considered useful within the prewash composition of the present invention. Such surfactants are believed to exhibit nonionic characteristics enabling them to function as equivalents within the composition of the present invention.

With the cosurfactant system described above, some stabilization is necessary within the prewash composition particularly for maintaining the relatively hydrophobic surfactant in solution within the composition. For this reason, a hydrotrope is included in the prewash composition preferably in the form of an anionic surfactant such as sodium xylene sulfonate. Although this is a preferred hydrotrope, it may be readily replaced within the prewash composition of the present invention for example by other benzene or naphthalene sulfonates containing one or more short chain alkyl substituents having about one to four carbon atoms. The hydrotrope may include any cationic counterion such as sodium, potassium, ammonium, etc. However, it is noted again that many other hydrotropes can probably be used in the present invention.

Preferred ranges for the above components including the hydrophobic and hydrophilic surfactants as well as the hydrotropes are set forth in Table I in accordance with the present invention provided that the equation set forth below regarding the ratio of hydrotrope to hydrophobic surfactant is satisfied.

TABLE I

FORMULA FOR A POURABLE, THICKENED, HIGH WATER PREWASH

| Material | Most Preferred wt. % | Preferred wt. % |
|---|---|---|
| Neodol 23-6.5 | 6.0–8.0 | 3.5–8.0 |
| Neodol 25-3 | 0.9–1.1 | 0.2–2.5 |
| Sodium Xylene Sulfonate | 3.2–4.0 | 1.6–10.0 |
| Xanthan Gum | 0.35–0.45 | 0.1–2.0 |
| Formalin | 0.17–0.23 | 0.17–0.23 |
| Perfume | 0.08–0.12 | 0–0.12 |
| Water | 86.1–89.3 | 77.15–94.43 |

As demonstrated in Table I and as is discussed further below, it is particularly important in connection with the present invention to maintain a specified ratio between the hydrotrope and the relatively hydrophobic surfactant particularly when the prewash composition is thickened with xanthan gum as is the case for all of the examples in Table I.

The ratio requirements between the hydrophobic surfactant and the hydrotrope are demonstrated in FIG. 1 which is a graphical representation formed from a large number of data points to demonstrate phase stability of the thickened prewash composition of the present invention. In order to establish the data in Table I, a number of different formulations were prepared as set forth in Tables II and III, portions of each of the formulations from Tables II and III being stored respectively at 2° C. (35° F.), 21° C. (70° F.) and 38° C. (100° F.). After being stored for a period of three days, the number of phases in each of the samples was determined. It was found that, if a formula exhibited one phase at 38° C., it also exhibited one phase at the lower temperatures.

TABLE II

EFFECT OF COMPOSITION ON PHASE STABILITY CONCENTRATION IN WEIGHT PERCENT

| Run | Neodol 23-6.5 | Neodol 25-3 | Sodium Xylene Sulfonate | Formalin | Perfume | Xanthan Gum | Number of Phases at 38° C. |
|---|---|---|---|---|---|---|---|
| 1 | 7.0 | 1.0 | 3.2 | 0.2 | 0.1 | 0.1 | 1 |
| 2 | 7.0 | 1.0 | 3.2 | 0.2 | 0.1 | 0.3 | 1 |
| 3 | 7.0 | 1.0 | 3.2 | 0.2 | 0.1 | 0.4 | 1 |
| 4 | 7.0 | 1.0 | 3.2 | 0.2 | 0.1 | 0.5 | 1 |
| 5 | 7.0 | 1.0 | 3.2 | 0.2 | 0.1 | 1.0 | 1 |
| 6 | 7.0 | 1.0 | 3.2 | 0.2 | 0.1 | 2.0 | 1 |
| 7 | 7.0 | 1.0 | 2.4 | 0.2 | 0.1 | 0.5 | 2 |
| 8 | 7.0 | 1.0 | 2.4 | 0.2 | 0.1 | 1.5 | 2 |
| 9 | 7.0 | 1.0 | 1.6 | 0.2 | 0.1 | 1.0 | 2 |
| 10 | 5.25 | 0.75 | 3.2 | 0.2 | 0.1 | 0.3 | 1 |
| 11 | 5.25 | 0.75 | 3.2 | 0.2 | 0.1 | 0.5 | 1 |
| 12 | 5.25 | 0.75 | 3.2 | 0.2 | 0.1 | 1.5 | 2 |
| 13 | 5.25 | 0.75 | 2.4 | 0.2 | 0.1 | 1.0 | 2 |
| 14 | 5.25 | 0.75 | 1.6 | 0.2 | 0.1 | 0.5 | 2 |
| 15 | 5.25 | 0.75 | 1.6 | 0.2 | 0.1 | 1.5 | 2 |
| 16 | 3.5 | 0.5 | 3.2 | 0.2 | 0.1 | 1.0 | 1 |
| 17 | 3.5 | 0.5 | 2.4 | 0.2 | 0.1 | 0.5 | 1 |
| 18 | 3.5 | 0.5 | 2.4 | 0.2 | 0.1 | 1.5 | 1 |
| 19 | 3.5 | 0.5 | 1.6 | 0.2 | 0.1 | 1.0 | 2 |
| 20 | 7.0 | 1.22 | 3.32 | 0.2 | 0.1 | 0.4 | 2 |
| 21 | 7.0 | 1.24 | 3.22 | 0.2 | 0.1 | 0.4 | 2 |
| 22 | 7.0 | 1.20 | 3.01 | 0.2 | 0.1 | 0.4 | 2 |
| 23 | 7.0 | 1.18 | 3.41 | 0.2 | 0.1 | 0.4 | 1 |
| 24 | 7.0 | 1.18 | 2.82 | 0.2 | 0.1 | 0.4 | 2 |
| 25 | 7.0 | 1.14 | 3.11 | 0.2 | 0.1 | 0.4 | 2 |
| 26 | 7.0 | 1.14 | 3.00 | 0.2 | 0.1 | 0.4 | 2 |
| 27 | 7.0 | 1.12 | 2.82 | 0.2 | 0.1 | 0.4 | 2 |
| 28 | 7.0 | 1.08 | 3.19 | 0.2 | 0.1 | 0.4 | 1 |
| 29 | 7.0 | 1.08 | 3.14 | 0.2 | 0.1 | 0.4 | 2 |
| 30 | 7.0 | 1.08 | 3.07 | 0.2 | 0.1 | 0.4 | 2 |
| 31 | 7.0 | 1.02 | 3.20 | 0.2 | 0.1 | 0.4 | 1 |

TABLE II-continued

EFFECT OF COMPOSITION ON PHASE STABILITY CONCENTRATION IN WEIGHT PERCENT

| Run | Neodol 23-6.5 | Neodol 25-3 | Sodium Xylene Sulfonate | Formalin | Perfume | Xanthan Gum | Number of Phases at 38° C. |
|---|---|---|---|---|---|---|---|
| 32 | 7.0 | 1.00 | 3.09 | 0.2 | 0.1 | 0.4 | 1 |
| 33 | 7.0 | 1.00 | 2.80 | 0.2 | 0.1 | 0.4 | 2 |
| 34 | 7.0 | 0.98 | 3.04 | 0.2 | 0.1 | 0.4 | 1 |
| 35 | 7.0 | 0.98 | 3.01 | 0.2 | 0.1 | 0.4 | 2 |
| 36 | 7.0 | 0.96 | 3.01 | 0.2 | 0.1 | 0.4 | 2 |
| 37 | 7.0 | 0.90 | 2.80 | 0.2 | 0.1 | 0.4 | 1 |
| 38 | 7.0 | 0.88 | 2.99 | 0.2 | 0.1 | 0.4 | 1 |
| 39 | 6.68 | 0.23 | 1.74 | 0.2 | 0.1 | 0.38 | 1 |
| 40 | 6.68 | 0.23 | 1.28 | 0.2 | 0.1 | 0.38 | 2 |
| 41 | 6.68 | 0.23 | 0.81 | 0.2 | 0.1 | 0.38 | 2 |
| 42 | 6.68 | 0.23 | 0.35 | 0.2 | 0.1 | 0.38 | 2 |
| 43 | 6.68 | 0.58 | 2.20 | 0.2 | 0.1 | 0.38 | 2 |
| 44 | 6.68 | 0.58 | 2.44 | 0.2 | 0.1 | 0.38 | 1 |
| 45 | 7.00 | 1.60 | 4.00 | 0.2 | 0.1 | 0.40 | 2 |
| 46 | 7.00 | 1.60 | 4.32 | 0.2 | 0.1 | 0.40 | 1 |
| 47 | 6.68 | 1.74 | 4.41 | 0.2 | 0.1 | 0.38 | 2 |
| 48 | 6.68 | 1.74 | 4.87 | 0.2 | 0.1 | 0.38 | 1 |
| 49 | 6.68 | 1.74 | 5.34 | 0.2 | 0.1 | 0.38 | 1 |
| 50 | 6.68 | 2.32 | 6.03 | 0.2 | 0.1 | 0.38 | 1 |
| 51 | 6.68 | 2.32 | 6.96 | 0.2 | 0.1 | 0.38 | 1 |
| 52 | 6.68 | 2.32 | 9.28 | 0.2 | 0.1 | 0.38 | 1 |
| 53 | 6.68 | 2.32 | 5.34 | 0.2 | 0.1 | 0.38 | 2 |
| 54 | 7.00 | 2.20 | 5.50 | 0.2 | 0.1 | 0.40 | 1 |

TABLE III

EFFECT OF COMPOSITION ON VISCOSITY CONCENTRATION IN WEIGHT PERCENT

| Run | Neodol 23-6.5 | Neodol 25-3 | Sodium Xylene Sulfonate | Formalin | Perfume | Xanthan Gum | Viscosity* at 21°C. (cP) | Number of Phases at 38° C. |
|---|---|---|---|---|---|---|---|---|
| 1 | 6.0 | 0.8 | 2.8 | 0.17 | 0.08 | 0.35 | 146 | 1 |
| 2 | 6.0 | 0.8 | 2.8 | 0.23 | 0.12 | 0.35 | 152 | 1 |
| 3 | 8.0 | 0.8 | 2.8 | 0.23 | 0.08 | 0.35 | 158 | 1 |
| 4 | 8.0 | 0.8 | 2.8 | 0.17 | 0.12 | 0.35 | 159 | 1 |
| 5 | 6.0 | 1.2 | 2.8 | 0.23 | 0.08 | 0.35 | 158 | 2 |
| 6 | 6.0 | 1.2 | 2.8 | 0.17 | 0.12 | 0.35 | 152 | 2 |
| 7 | 8.0 | 1.2 | 2.8 | 0.17 | 0.08 | 0.35 | 161 | 2 |
| 8 | 8.0 | 1.2 | 2.8 | 0.23 | 0.12 | 0.35 | 160 | 2 |
| 9 | 6.0 | 0.9 | 3.2 | 0.20 | 0.12 | 0.35 | 162 | 1 |
| 10 | 8.0 | 0.9 | 3.2 | 0.20 | 0.08 | 0.35 | 158 | 1 |
| 11 | 6.0 | 1.1 | 3.2 | 0.20 | 0.08 | 0.35 | 156 | 1 |
| 12 | 8.0 | 1.1 | 3.2 | 0.20 | 0.12 | 0.35 | 158 | 1 |
| 13 | 6.0 | 0.8 | 3.6 | 0.23 | 0.08 | 0.35 | 158 | 1 |
| 14 | 6.0 | 0.8 | 3.6 | 0.17 | 0.12 | 0.35 | 156 | 1 |
| 15 | 8.0 | 0.8 | 3.6 | 0.17 | 0.08 | 0.35 | 161 | 1 |
| 16 | 8.0 | 0.8 | 3.6 | 0.23 | 0.12 | 0.35 | 159 | 1 |
| 17 | 6.0 | 1.2 | 3.6 | 0.23 | 0.08 | 0.35 | 152 | 1 |
| 18 | 6.0 | 1.2 | 3.6 | 0.17 | 0.08 | 0.35 | 149 | 1 |
| 19 | 8.0 | 1.2 | 3.6 | 0.17 | 0.12 | 0.35 | 161 | 1 |
| 20 | 8.0 | 1.2 | 3.6 | 0.23 | 0.12 | 0.35 | 156 | 1 |
| 21 | 6.0 | 0.9 | 4.0 | 0.20 | 0.08 | 0.35 | 164 | 1 |
| 22 | 8.0 | 0.9 | 4.0 | 0.20 | 0.12 | 0.35 | 160 | 1 |
| 23 | 6.0 | 1.1 | 4.0 | 0.20 | 0.12 | 0.35 | 156 | 1 |
| 24 | 8.0 | 1.1 | 4.0 | 0.20 | 0.08 | 0.35 | 160 | 1 |
| 25 | 7.0 | 1.0 | 3.2 | 0.20 | 0.10 | 0.40 | 185 | 1 |
| 26 | 7.0 | 1.0 | 3.6 | 0.20 | 0.10 | 0.40 | 186 | 1 |
| 27 | 6.0 | 0.8 | 2.8 | 0.23 | 0.08 | 0.45 | 224 | 1 |
| 28 | 6.0 | 0.8 | 2.8 | 0.17 | 0.12 | 0.45 | 217 | 1 |
| 29 | 8.0 | 0.8 | 2.8 | 0.17 | 0.08 | 0.45 | 214 | 1 |
| 30 | 8.0 | 0.8 | 2.8 | 0.23 | 0.12 | 0.45 | 221 | 1 |
| 31 | 6.0 | 1.2 | 2.8 | 0.17 | 0.08 | 0.45 | 214 | 2 |
| 32 | 6.0 | 1.2 | 2.8 | 0.23 | 0.12 | 0.45 | 216 | 2 |
| 33 | 8.0 | 1.2 | 2.8 | 0.23 | 0.08 | 0.45 | 219 | 2 |
| 34 | 8.0 | 1.2 | 2.8 | 0.17 | 0.12 | 0.45 | 219 | 2 |
| 35 | 6.0 | 0.9 | 3.2 | 0.20 | 0.08 | 0.45 | 218 | 1 |
| 36 | 8.0 | 0.9 | 3.2 | 0.20 | 0.12 | 0.45 | 198 | 1 |
| 37 | 6.0 | 1.1 | 3.2 | 0.20 | 0.12 | 0.45 | 214 | 1 |
| 38 | 8.0 | 1.1 | 3.2 | 0.20 | 0.08 | 0.45 | 214 | 1 |
| 39 | 6.0 | 0.8 | 3.6 | 0.17 | 0.08 | 0.45 | 226 | 1 |
| 40 | 6.0 | 0.8 | 3.6 | 0.23 | 0.12 | 0.45 | 223 | 1 |
| 41 | 8.0 | 0.8 | 3.6 | 0.23 | 0.08 | 0.45 | 229 | 1 |
| 42 | 8.0 | 0.8 | 3.6 | 0.17 | 0.12 | 0.45 | 222 | 1 |

TABLE III-continued

EFFECT OF COMPOSITION ON VISCOSITY CONCENTRATION IN WEIGHT PERCENT

| Run | Neodol 23-6.5 | Neodol 25-3 | Sodium Xylene Sulfonate | Formalin | Perfume | Xanthan Gum | Viscosity* at 21°C. (cP) | Number of Phases at 38° C. |
|---|---|---|---|---|---|---|---|---|
| 43 | 6.0 | 1.2 | 3.6 | 0.23 | 0.08 | 0.45 | 228 | 1 |
| 44 | 6.0 | 1.2 | 3.6 | 0.17 | 0.12 | 0.45 | 222 | 1 |
| 45 | 8.0 | 1.2 | 3.6 | 0.17 | 0.08 | 0.45 | 220 | 1 |
| 46 | 8.0 | 1.2 | 3.6 | 0.23 | 0.12 | 0.45 | 219 | 1 |
| 47 | 6.0 | 0.9 | 4.0 | 0.20 | 0.12 | 0.45 | 221 | 1 |
| 48 | 8.0 | 0.9 | 4.0 | 0.20 | 0.08 | 0.45 | 222 | 1 |
| 49 | 6.0 | 1.1 | 4.0 | 0.20 | 0.08 | 0.45 | 216 | 1 |
| 50 | 8.0 | 1.1 | 4.0 | 0.20 | 0.12 | 0.45 | 222 | 1 |

*Viscosities set forth in this Table and elsewhere in connection with the present invention are measured with a Brookfield viscosimeter using a number two spindle at 100 rpm and 21° C. (70° F.).

Based on the data developed in FIG. 1 as noted above, a boundary 101 was developed to predict phase stability between various proportions of hydrotrope and the relatively hydrophobic surfactant from the cosurfactant system. At a temperature of 38° C., the phase boundary 101 was found to be approximated by the equation:

$$\text{Weight \% hydrotrope} = 1.10 + 1.91 \times \text{weight \% Neodol 25-3}$$

As is also illustrated in Tables II and III, the concentrations of the other ingredients in the various formulations do not substantially affect phase stability at 38° C. Also, it is noted in connection with FIG. 1 and the above equation that other surfactants equivalent to the relatively hydrophobic surfactant (Neodol 25-3) produce a similar phase boundary as illustrated in FIG. 1.

Further with respect to the phase boundary 101 in FIG. 1, it was found that the entire phase boundary 101 tends to be shifted toward the right with the result that a slightly increased amount of hydrotrope would be required for each part of relatively hydrophobic surfactant at temperatures greater than 38° C. Similarly, for temperatures less than 38° C. the phase boundary 101 tends to shift leftwardly indicating a need for a slightly lesser amount of hydrotrope for each part of relatively hydrophobic surfactant in the formulation. The change in the amount of hydrotrope is relatively small at least for temperatures commonly contemplated in connection with the prewash composition.

Before leaving the discussion of the surfactant system, it is again noted that other hydrotropes equivalent to sodium xylene sulfonate could be employed in the formulations of Tables I–III and FIG. 1 with generally similar results. At the same time, it is also noted that the hydrotrope is necessary in the prewash composition for the purpose of maintaining stability particularly when one or more surfactants in the surfactant system is relatively hydrophobic and exhibits limited water solubility. Accordingly, if the surfactant system were formulated only with one or more water soluble surfactants, the hydrotrope would not be required in the composition. Thus, if the surfactant system could be developed with one or more water soluble surfactants properly selected to also exhibit oil soluble characteristics, it would be possible according to the present invention to develop the prewash composition having balanced detergency characteristics for both water soluble and oil soluble spots or stains without the need for a hydrotrope. At the same time, such a composition could still have stability of the type contemplated as being necessary in accordance with the present invention. To provide a more complete teaching of the present invention in this regard, a further exemplary composition is set forth below as Run #5 in Table IX to demonstrate such a surfactant system which does not include a hydrotrope.

WATER

As noted above, the present invention contemplates an aqueous prewash composition which includes water as a predominant component comprising at least fifty percent by weight of the composition. Preferably, for purposes of forming an economical composition while maintaining the thickened and pourable characteristics noted above for the composition, water is present in the composition to the extent of about eighty to ninety percent by weight. Examples of the aqueous nature of the prewash composition are believed to be clearly demonstrated by the formulations set forth in the tables and examples herein. As was also noted above, water content is considered only in connection with the aqueous system of the prewash composition. For example, if large amounts of insoluble or partially soluble particles are suspended in the composition, the quantity of insoluble particles would not be considered in determining the aqueous percentage of the prewash composition.

THICKENER

As noted above, one of the particularly important features of the present invention is the ability to form an aqueous thickened prewash composition which exhibited substantial stability in accordance with the preceding description. In developing a thickened prewash composition according to the present invention, a large number of relatively conventional thickeners were tested and found to be unsuitable for achieving the combined conditions of a thickened composition and stability in accordance with the present invention. In this regard, Table IV sets forth a preferred prewash composition according to the present invention which was employed for screening a number of thickeners. The thickeners tested in connection with the composition of Table IV are set forth in Table V. Here again, formulations including the basic composition of Table IV and each of the thickeners from Table V were prepared with portions of each formulation being stored for three days at the same temperatures noted above in connection with FIG. 1. In terms of the present invention, failure of the thickener was predicated upon the formulation either exhibiting more than one phase after three days storage or gellation indicated by a lack of flow.

TABLE IV

FORMULA FOR SCREENING THICKENERS

| MATERIAL | WT. % |
|---|---|
| Neodol 23-6.5 | 7.0 |
| Neodol 25-3 | 1.0 |
| Sodium Xylene Sulfonate | 3.2 |
| Formalin | 0.2 |
| Perfume | 0.1 |
| Thickener | See Table V |
| Water | Balance |
| | 100.0% |

TABLE V

THICKENERS THAT FAILED TO WORK

| THICKENER | WT. % |
|---|---|
| Guar Gum | 0.1–1.0 |
| 1:1 Xanthan Gum/Locust Bean Gum | 0.2 |
| Hydroxypropyl methyl cellulose (Methocel J75M) | 0.1–1.0 |
| Methylcellulose (Methocel A4C) | 2.0 |
| Methylcellulose (Methocel A15C) | 1.5 |
| Polyvinyl Alcohol (120,000 MW, 88% hydrolyzed) | 6.0 |
| Polyethylene Oxide (600,000 MW) | 2.5 |
| Polyethylene Oxide (900,00 MW) | 2.0 |
| Polyacrylic Acid (Goodrite K-702) | 0.025–0.25 |
| 1:1 Polyacrylic Acid (Carbopol 941)/50% NaOH | 0.2–1.0 |
| Hydroxyoctacosanylhydroxy stearate (Elfacos C26) | 0.5–5.0 |
| Sodium Magnesium Silicate (Laponite) | 0.5–5.0 |
| 1:1 Laponite/50% NaOH | 0.5–5.0 |
| Hectorite with Hydroxyethylcellulose (Bentone LT) | 0.5–1.5 |
| Montmorillonite, organically modified (Bentone SD1) | 0.5–2.0 |
| Montmorillonite, organically modified (Bentone SD2) | 1.0–2.0 |

It is again noted that the thickeners of Table V are set forth only for the purpose of demonstrating the difficulty of achieving the combined characteristics of thickening and stability in an aqueous prewash composition. Only three specific thickeners were found to produce the desired characteristic of thickening with the composition still being stable in accordance with the preceding discussion. These included xanthan gum (as discussed in greater detail below), polyacrylic acid preferably of a branched type and having a molecular weight of about 1,250,000 (available for example under the trade name Carbopol 941 from B. F. Goodrich Chemical Company, Akron, Ohio) and polystyrene sulfonate having a molecular weight of about 6,000,000 (available for example from Scientific Polymer Products, Inc.). Prewash compositions including Carbopol 941 and polystyrene sulfonate are set forth below in Tables X and XI.

Of the three materials listed above, the polyacrylic acid and polystyrene sulfonate were not as effective as xanthan gum. Different sources for xanthan gum tested in the invention are set forth in Table VI. Specific examples including polyacrylic acid and polystyrene sulfonate are set forth below. Generally, although a prewash composition was developed with polystyrene sulfonate exhibiting both thickening and stability, stability was not as satisfactory as with compositions including xanthan gum. Also, large amounts, for example, 5.0% or more, of polystyrene sulfonate are required to attain the most preferred viscosities of the invention. As for prewash compositions developed with polyacrylic acid, they also exhibited the combined functions of thickening and stability. However, detergency of the compositions including polyacrylic acid was not as good as compositions including xanthan gum. In this regard, note the data set forth in Table VII in connection with comparative stain removal for prewash compositions including polyacrylic acid as a thickener and those including xanthan gum as a thickener.

TABLE VI

EFFECT OF SOURCE XANTHAN GUM ON PREFERRED FORMULA

| Trade Name of Xanthan Gum | Manufacturer | Lot Number | Number of Phases at 38° C. | Viscosity at 21° C. (cP) |
|---|---|---|---|---|
| Keltrol | Kelco | 422801C | 1 | — |
| Kelzan | Kelco | 490091C | 1 | 169 |
| Kelzan | Kelco | 81176A | 1 | 186 |

TABLE VI-continued

EFFECT OF SOURCE XANTHAN GUM ON PREFERRED FORMULA

| Trade Name of Xanthan Gum | Manufacturer | Lot Number | Number of Phases at 38° C. | Viscosity at 21° C. (cP) |
|---|---|---|---|---|
| Kelzan | Kelco | 80168A | 1 | 181 |
| Rheogel | Iranex | 55395 | 1 | 202 |
| Flocon 4800C | Pfizer | — | 1 | 147 |

TABLE VII

STAIN REMOVAL FROM COTTON SWATCHES*

| Treatment | Visual Grades** | | | | | | |
|---|---|---|---|---|---|---|---|
| | Dirty Motor Oil | Spaghetti Sauce | Ball Point Ink | Grass | Clay | Average | Average for Three Fabrics° |
| Detergent only | 1.4 | 2.7 | 2.3 | 1.6 | 4.3 | 2.4 | 2.8 |
| Detergent & pretreatment*** | 2.4 | 3.1 | 2.8 | 2.4 | 4.2 | 3.0 | 3.0 |
| Carbopol System of Table X**** | 2.8 | 3.0 | 2.7 | 1.8 | 3.4 | 2.7 | 2.8 |
| LSD (t-test, = 0.05)+ | 0.4 | 0.2 | 0.5 | 0.1 | 0.3 | 0.2 | 0.15 |

*Washed in washing machines in a 38° C. (100° F.) wash and a 21° C. (70° F.) rinse with water hardness adjusted to 100 ppm as $CaCO_3$

**No removal = 1; complete removal = 5. Average of five graders.

***Formula in Table I with 0.4 wt. % xanthan gum.

****Formula in Table X with 0.4 wt. % Carbopol.

+Least Significant Difference Test (Fisher)

°The three fabrics tested include polycotton (65/35), polyester and cotton.

The greater effectiveness of xanthan gum compared to either polyacrylic acid or polystyrene sulfonate is not completely understood. However, the particularly effective and unexpected ability of xantham gum to function within the present invention is clearly demonstrated by the examples set forth in the preceding Tables. As for the relatively poorer detergency accomplished with polyacrylic acid, it is at least theorized that the polyacrylic acid may tend to tie up one or more surfactants in the surfactant system, thus causing a decrease in detergency as demonstrated above in Table VII.

Xanthan gum as the preferred thickener in the present invention is a high molecular weight natural carbohydrate produced by fermentation. Generally, it is believed that xanthan gum has a cellulose-like backbone or chain composed of repeating $\beta$-D-(1–4) glucose units. A side chain is connected to the number three position of every other glucose unit. The side chains consist of a terminal $\beta$-D-mannose unit glycosidically linked to the number 4 position of a $\beta$-D-glucuronic acid which in turn is linked to the number 2 position of an $\alpha$-D-mannose unit that contains an acetyl group at the number 6 position. In addition, a portion of the terminal mannose units have a pyruvate ketal attached to the number 4 and number 6 positions. Table VI lists several types of xanthan gum which differ from each other generally in the portion of side chains containing pyruvate groups.

The xanthan gums available under the trade names, Kelzan and Keltrol from Kelco, a division of Merck & Co., Inc. have pyruvate groups on approximately 30 to 40 percent of the side chains. Another xanthan gum available under the trade name Flocon from Pfizer Chemical Division of Pfizer, Inc. has approximately 70 to 80 percent of the side chains containing pyruvate groups. The greater amount of pyruvate groups in these products makes them somewhat more water soluble and accounts for the slightly lower viscosity in prewash compositions including these xanthan gum products.

Another xanthan gum employed in certain formulations was available under the trade name Rheogel from Iranex Company. The structure of this xanthan gum is unknown but is believed to be similar to the xanthan gums described above under the trade names Kelzan and Keltrol.

Referring again to Table I set forth above, the most preferred formula for prewash composition according to the present invention includes approximately 0.35 to about 0.45 percent by weight of xanthan gum with additional components as described in Table I. These products demonstrated a viscosity of between about 140 to 230 centipoise at 21° C. as measured by a Brookfield RVT viscosimeter using a number 2 spindle at about 100 rpm.

As noted above, a particular advantage for using xanthan gum in the prewash composition of the present invention lies not only in its ability to thicken the composition while allowing the composition to remain stable but also in the development of thixotropic or pseudoplastic properties which further enhance the properties of the prewash composition for use in laundry pretreatment applications. Here again, although Carbopol 941 and polystyrene sulfonate caused thickening as noted above, they provided only a very small increase in viscosity, or less thixotropy, as shear is reduced. In particular, the use of xanthan gum enables the prewash composition to exhibit substantially reduced viscosity under shear resulting, for example, from pouring or dispensing of the composition from conventional containers. In this connection, reference is made to FIG. 2 which sets forth the Brookfield viscosity for the preferred formulation set forth above with 0.40 percent by weight xanthan gum as a function of shear rate and temperature. FIG. 2 illustrates the ability of the prewash composition of the present invention to exhibit reduced viscosity under shear conditions such as are experienced during dispensing of the product. Once the product is in place upon fabric spots or stains and no longer experiences shear, the viscosity of the product is immediately increased thus enhancing its ability to remain in localized engagement with the fabric spots or stains.

Thus, in accordance with the preceding description, the present invention relates to a prewash composition including a surfactant system which may comprise a cosurfactant system or otherwise together with a hydrotrope is necessary for stability, water as a predominant component and a thickener. As noted above, the preferred thickener for the prewash composition of the present invention is xanthan gum although additional examples of effective thickeners are also set forth above.

The thickened or high viscosity nature of the prewash composition also makes it possible to provide the prewash composition of the present invention in yet another form including insoluble particles such as enzyme prills, bluing agents, for example ultramarine blue, dyeing agents and abrasives. Such insoluble particles have obviously desirable characteristics for use in prewash compositions. However, they have generally not been available in prewash compositions available heretofore because of their insoluble nature and their tendency to separate out and form a solid phase in the product. Accordingly, in the prior art, it would have been necessary in a product including such insoluble particles to include instructions for shaking the prewash container prior to use in order to assure mixture of the insoluble particles in the dispensed material. A particularly effective and heretofore unexpected advantage of the thickened aqueous prewash composition of the present invention is thus its ability to maintain such insoluble particles in suspension.

To further demonstrate the utility of the present prewash composition in this regard, Table VIII is set forth hereinbelow demonstrating a number of examples of prewash compositions according to the present invention, each including an abrasive as a suspended component. The presence of abrasive materials in a prewash composition is believed desirous because of the normal instructions or tendency for users to rub the fabric after the prewash composition has been applied to it. The presence of the abrasive material, of course, enhances cleaning of the fabric and removal of spots and stains during such action. Typical abrasive materials in this regard may include soft particles such as polyethylene beads, or wax, ground nut hulls, ground corncobs, silica or calcium carbonate for example. Generally, it has been found that such abrasive materials may be included within a prewash composition according to the present invention in amounts up to 50 percent by weight. If such large amounts of abrasive material were to be used in the prewash composition, it may be desirable to adjust the active components of the composition including the surfactants, etc. in the aqueous portion of the composition in order to assure the presence of sufficient material for proper detergency.

However, it is generally contemplated that such abrasive materials be included in the amount of about one to forty and preferably from about ten to twenty percent by weight of the prewash composition. As for the other insoluble particles listed above, it is generally noted that enzyme prills and bluing agents might be present at about one percent by weight of the composition.

TABLE VIII

STABLE THICKENED AQUEOUS PREWASH COMPOSITIONS WITH ABRASIVE (CONCENTRATIONS IN WEIGHT PERCENT)

| Run | Neodol 23-6.5 | Neodol 25-3 | Sodium Xylene Sulfonate | Formalin | Perfume | Xanthan Gum | Calcium* Carbonate |
|---|---|---|---|---|---|---|---|
| 1 | 7.0 | 1.0 | 3.6 | 0.2 | 0.1 | 0.40 | 1 |
| 2 | 7.0 | 1.0 | 3.6 | 0.2 | 0.1 | 0.36 | 10 |
| 3 | 7.0 | 1.0 | 3.6 | 0.2 | 0.1 | 0.32 | 20 |
| 4 | 6.3 | 0.9 | 3.2 | 0.2 | 0.1 | 0.36 | 10 |
| 5 | 5.6 | 0.8 | 2.9 | 0.2 | 0.1 | 0.32 | 20 |
| 6 | 4.2 | 0.6 | 2.2 | 0.2 | 0.1 | 0.24 | 40 |

*Calcium carbonate particles in the size range of about 20 to 30 microns.

In addition to Table VIII, other examples of prewash compositions according to the present invention were set forth in the preceding Tables I–VII. As noted above, reference was also made to a prewash composition according to the present invention wherein the surfactant system included a single surfactant without the need for a hydrotrope such as sodium xylene sulfonate. Such a composition is set forth below as Table IX.

TABLE IX

STABLE THICKENED AQUEOUS PREWASH COMPOSITIONS WITH A SINGLE SURFACTANT (CONCENTRATIONS IN WEIGHT PERCENT)

| Run | Neodol 23-6.5 | Neodol 25-3 | Sodium Xylene Sulfonate | Formalin | Perfume | Xanthan Gum | Number of Phases at 38° C. |
|---|---|---|---|---|---|---|---|
| 1 | 7.00 | 0.00 | 3.60 | 0.2 | 0.1 | 0.40 | 1 |
| 2 | 7.00 | 0.00 | 1.20 | 0.2 | 0.1 | 0.40 | 1 |
| 3 | 7.00 | 0.00 | 1.00 | 0.2 | 0.1 | 0.40 | 1 |
| 4 | 7.00 | 0.00 | 0.80 | 0.2 | 0.1 | 0.40 | 1 |
| 5 | 7.00 | 0.00 | 0.00 | 0.2 | 0.1 | 0.40 | 1 |

Various examples of a thickened prewash composition according to the present invention and including Carbopol 941 as a thickener are set forth below in Table X in the form of a most preferred composition and a broader preferred range of components in a prewash composition.

TABLE X

THICKENED PREWASH COMPOSITION INCLUDING CARBOPOL 941

| Material | Preferred Wt. % | Most Preferred Wt. % |
|---|---|---|
| Neodol 23-6.5 | 5.0–8.0 | 7.0 |
| Neodol 25-3 | 0.7–1.2 | 1.0 |
| Sodium Xylene Sulfonate | 0.6–3.2 | 0.8 |
| Carbopol 941 | 0.3–1.5 | 0.4 |
| Formalin | 0.15–0.25 | 0.2 |
| Perfume | 0–0.2 | 0.1 |
| Water | Balance | 90.5 |

Tables XI and XII, as set forth below, illustrate additional examples of a prewash composition according to the present invention using polystyrene sulfonate as a thickener.

TABLE XI

THICKENED PREWASH COMPOSITIONS INCLUDING POLYSTYRENE SULFONATE

| Material | Wt. % | | |
|---|---|---|---|
| | Run 1 | Run 2 | Run 3 |
| Neodol 23-6.5 | 7.0 | 5.25 | 7.0 |
| Neodol 25.3 | 1.0 | 0.75 | 1.0 |
| Sodium Xylene Sulfonate | 1.2 | 2.4 | 2.4 |
| Polystyrene Sulfonate | 5.0 | 5.0 | 8.0 |
| Formalin | 0.2 | 0.2 | 0.2 |
| Perfume | 0.1 | 0.1 | 0.1 |
| Water | 85.5 | 82.7 | 77.7 |

TABLE XII

PREFERRED FORMULA FOR THICKENED PREWASH COMPOSITION INCLUDING POLYSTYRENE SULFONATE

| Material | Preferred Wgt. % | Most Preferred Wgt. % |
|---|---|---|
| Neodol 23-6.5 | 5–8 | 7.0 |
| Neodol 25.3 | 0.7–1.2 | 1.0 |
| Sodium Xylene Sulfonate | 1.0–3.2 | 1.2 |
| Polystyrene Sulfonate | 2.0–10.0 | 5.0 |
| Formalin | 0.15–0.25 | 0.2 |
| Perfume | 0–0.2 | 0.1 |

TABLE XII-continued

| PREFERRED FORMULA FOR THICKENED PREWASH COMPOSITION INCLUDING POLYSTYRENE SULFONATE | | |
|---|---|---|
| Material | Preferred Wgt. % | Most Preferred Wgt. % |
| Water | Balance | 85.5 |

A method for removing localized soil from a fabric is believed obvious from the preceding description. However, to assure a complete understanding of the invention, such a method is carried out by contacting the localized fabric soil with a prewash composition according to the present invention, for example, any of the compositions set forth above and then further treating the fabric, for example, by conventional laundering.

Accordingly, there has been disclosed above a number of embodiments for a thickened aqueous prewash composition according to the present invention. While preferred embodiments of the invention have been illustrated and described above, it is to be understood that these embodiments are capable of further variation and modification; therefore, the present invention is not to be limited to precise details of the embodiments set forth above but to be taken with such changes and variations as fall within the purview of the following claims.

What is claimed is:

1. An aqueous laundry prewash composition for treating fabric spots, stains and the like, comprising a cosurfactant system including a first hydrophobic nonionic surfactant for loosening oil soluble material from the fabric and a second hydrophilic nonionic surfactant for loosening water soluble material from the fabric, the hydrophobic nonionic surfactant being an oil soluble ethoxylated alcohol with about eight to eighteen carbon atoms and an average of about two to five ethylene oxide groups per molecule, the hydrophilic nonionic surfactant being a water soluble ethoxylated alcohol with about eight to eighteen carbon atoms and an average of about five to fifteen ethylene oxide groups per molecule, the cosurfactant system forming about 3.7–10.5 weight percent of the composition, a hydrotrope selected for stabilizing the cosurfactant system and particularly the first hydrophobic nonionic surfactant in the prewash composition, the hydrotrope being a benzene or naphthalene sulfonate derivative containing one or more short chain alkyl substituents with about one to four carbon atoms, the hydrotrope forming about 1.6–10.0 weight percent of the composition, Xanthan gum as a thickener for maintaining viscosity of the composition in a thickened condition and for achieving localized engagement of the composition on the fabric spots and stains, the thickener forming about 0.1–2 percent by weight of the composition, and water forming the balance of the compositions as a predominant component thereof, the hydrotrope being present in the composition in a ratio of at about three parts for each part of the first hydrophobic nonionic surfactant in order to assure stability of the thickened prewash composition.

2. The prewash composition of claim 1 wherein the thickener is further selected for maintaining viscosity of the prewash composition in the range of about 50 to 2,000 centipoise to form a stable pourable product tending to remain in localized engagement on the fabric spots and stains, the viscosity corresponding to measurement with a Brookfield viscosimeter using a number 2 spindle at 100 rpm and 21° C.

3. The prewash composition of claim 1 wherein the xanthan gum thickener is present in an amount selected for producing a viscosity of 100 to 300 centipoise in the prewash composition.

4. The prewash composition of claim 1 wherein the hydrotrope is an alkyl aryl sulfonate containing at least one short chain alkyl substituent with about one to four carbon atoms.

5. The prewash composition of claim 2 further comprising an insoluble particle component forming up to about fifty weight percent of the composition and selected from the class consisting of enzyme prills, bluing agents, dyeing agents and abrasives, the viscosity of the prewash composition being selected for maintaining the insoluble particle component in suspension.

6. The prewash composition of claim 5 wherein the insoluble particle component is an abrasive comprising about 1–40 percent by weight of the composition, the abrasive being selected for enhancing action of the prewash composition during normal rubbing of the fabric.

7. The prewash composition of claim 1 wherein the amount of hydrotrope based on the amount of the first hydrophobic nonionic surfactant is defined by the equation:

$$\text{Wgt \% hydrotrope} = 1.10 + 1.91\ (\text{wgt \% first hydrophobic nonionic surfactant}).$$

8. A method for removing localized soil from a fabric, comprising contacting the localized fabric soil with a prewash composition including a cosurfactant system including a first hydrophobic nonionic surfactant for loosening oil soluble material from the fabric and a second hydrophilic nonionic surfactant for loosening water soluble material from the fabric, the first hydrophobic nonionic surfactant being an oil soluble ethoxylated alcohol with about eight to eighteen carbon atoms and an average of about two to five ethylene oxide groups per molecule, the second hydrophilic nonionic surfactant being a water soluble ethoxylated alcohol with about eight to eighteen carbon atoms and an average of about five to fifteen ethylene oxide groups per molecule, the cosurfactant system forming about 3.7–10.5 weight percent of the prewash composition, a hydrotrope selected from the class consisting of benzene and naphthalene sulfonate derivatives containing one or more short chain alkyl substituents having about one to four carbon atoms for stabilizing the cosurfactant system and particularly the first hydrophobic nonionic surfactant in the prewash composition, a thickener selected from the class consisting of xanthan gum, polyacrylic acid and polystyrene sulfonate for maintaining viscosity of the composition in a thickened condition in order to maintain the composition in localized engagement on the fabric spots and stains, the thickener forming about 0.1–2 percent by weight of the prewash composition, and water forming the balance of the composition as a predominant component thereof, the hydrotrope being present in the composition in a ratio of at least three parts for each part of the first hydrophobic nonionic surfactant in order to assure stability of the thickened prewash composition.

9. The method of claim 8 wherein the thickener is further selected for maintaining viscosity of the prewash composition in the range of about 50 to 2,000 centipoise to form a stable pourable product tending to remain in localized engagement on the fabric spots and stains, the viscosity corresponding to measurement with a Brookfield viscosimeter using a number 2 spindle at 100 rpm and 21° C.

10. The method of claim 9 wherein the thickener is xanthan gum.

11. The method of claim 9 further comprising an insoluble particle component forming up to about fifty percent by weight of the prewash composition and selected from the class consisting of enzyme prills, bluing agents, dyeing agents and abrasives, the viscosity of the prewash composition being selected for maintaining the insoluble particle component in suspension.

12. The method of claim 11 wherein the insoluble particle component is an abrasive comprising about 1–40 percent by weight of the composition, the abrasive being selected for enhancing action of the prewash composition during normal rubbing of the fabric.

13. The method of claim 10 wherein the xanthan gum thickener is present in an amount selected for producing a viscosity of 100 to 300 centipoise in the prewash composition.

14. The method of claim 10 wherein the amount of hydrotrope based on the amount of the first hydrophobic nonionic surfactant is defined by the equation:

$$\text{Wgt \% hydrotrope} = 1.10 + 1.91\ (\text{wgt \% first hydrophobic nonionic surfactant}).$$

* * * * *